US005473828A

United States Patent [19]

Kishi

[11] Patent Number: 5,473,828

[45] Date of Patent: Dec. 12, 1995

[54] STRUCTURE OF A CLAMSHELL BUCKET AND A HYDRAULIC CONTROL CIRCUIT

[75] Inventor: Mitsuhiro Kishi, Ashikaga, Japan

[73] Assignee: Japanic Corporation, Ashikaga, Japan

[21] Appl. No.: 345,494

[22] Filed: Nov. 28, 1994

[30] Foreign Application Priority Data

Dec. 10, 1993 [JP] Japan ..... 5-340963

[51] Int. Cl.[6] ..... B66C 3/02

[52] U.S. Cl. ..... 37/187; 37/461; 91/468; 91/512; 91/516; 91/535; 414/726; 294/68.23

[58] Field of Search ..... 37/461, 184, 185, 37/186, 187, 188; 414/725, 695.5, 694, 722, 726; 91/468, 512, 516, 518, 535; 60/420, 421, 422; 294/68.23

[56] References Cited

U.S. PATENT DOCUMENTS

| | | | |
|---|---|---|---|
| 1,084,054 | 1/1914 | Wray et al. | 91/535 X |
| 3,187,916 | 6/1965 | O'Leary | 37/461 X |
| 3,323,234 | 6/1967 | Pickrell | 37/461 |
| 3,451,151 | 6/1969 | Guinot | 37/188 |
| 3,737,059 | 6/1973 | Peterson et al. | 37/184 X |
| 3,739,823 | 6/1973 | Bartell | 37/186 X |
| 3,809,248 | 5/1974 | Ohniwa et al. | 91/512 X |
| 3,920,137 | 11/1975 | McCain | 37/187 X |
| 4,327,943 | 5/1982 | Longo | 37/461 X |
| 4,602,444 | 7/1986 | Endo | 37/187 X |
| 4,642,019 | 2/1987 | Sutton | 91/516 X |
| 4,646,849 | 3/1987 | Watvedt | 91/516 X |
| 4,799,851 | 1/1989 | Swanson | 91/535 X |
| 4,882,859 | 11/1989 | Bollinger | 37/187 |
| 5,335,499 | 8/1994 | Thompson et al. | 91/512 X |
| 5,375,348 | 12/1994 | Kishi | 37/186 |
| 5,377,432 | 1/1995 | Kishi | 37/186 |

*Primary Examiner*—Terry Lee Melius
*Assistant Examiner*—Victor Batson
*Attorney, Agent, or Firm*—Flynn, Thiel, Boutell & Tanis

[57] ABSTRACT

To excavate sticky soil such as clayey soil, left and right buckets of a clamshell bucket are slightly inclined, thereby reducing the force to pull the buckets from a hole. The clamshell bucket includes left and right buckets which are closable, thereby holding soil, and a hydraulic cylinder having a stroke reserve so as to be further extendible after the buckets are closed, whereby the closed buckets can be displaced sidewardly relative to the vertical.

7 Claims, 8 Drawing Sheets

STRUCTURE OF A CLAMSHELL BUCKET AND A HYDRAULIC CONTROL CIRCUIT

FIELD OF THE INVENTION

This invention relates to a clamshell bucket arrangement for deeply excavating the earth to form a hole having a depth which is too long for its diameter, and particularly to a structure of the clamshell bucket and a hydraulic control circuit thereof capable of reducing pull up force of the bucket when excavating sticky earth such as claylike soil.

BACKGROUND OF THE INVENTION

There have been many cases at a construction site, building site, etc. where the earth should be deeply excavated to form a hole having a depth which is too long for its diameter. For example, there have been cases for excavating the earth to form a hole in which an anchor supporting a steel tower is embedded, a hole in which a water purifier tank is embedded, a hole for ground-making and a hole for well sinking. In such cases, the hole should generally have a depth which is too long (e.g. ranging from 15 m to 20 m) for its diameter (e.g. about 5 m).

In deep excavating work, a construction machine is conventionally employed having a stretchable arm fixed to a boom wherein a clamshell bucket arrangement is coupled to a tip end of a top arm of the stretchable arm and is suspended vertically by the weight thereof. In this construction machine, the clamshell bucket is first hung to reach the bottom of the hole so as to bite into the sand and it closes after holding the sand. The clamshell bucket is successively pulled upward from the hole while it is closed and then it is opened over the ground or a truck bed, thereby transferring the held sand. If the operations are repeated, it is possible to excavate the earth deeper to form a deeper hole.

Such conventional clamshell bucket arrangement comprises a support shaft which forms a main frame thereof and is suspended from the top arm, two buckets supported by both sides of the lower end of the support shaft so as to be closable to the left and right, and teeth fixed to both sides of each bucket at the portion where these buckets confront each other. In such an arrangement, the sand can be held when the buckets supported by the support shaft are closed, and it can be dropped when the buckets are opened. The structure of this clamshell bucket is well known and is employed on construction machines when excavating soft ground.

In such a clamshell bucket arrangement, it is possible to easily excavate the earth by closing the buckets on soft earth which is not sticky such as a sandy soil, thereby increasing the working efficiency. However, in ground such as claylike (i.e. clayey) soil having fine granules and moisture content, the outer periphery of the clamshell bucket sticks to the clayey soil of the hole so that air does not enter the contact surfaces between the buckets and the clayey soil because of viscosity of the clayey soil, thereby causing the generation of a so-called sticky phenomenon where the buckets are stuck by the clayey soil. This phenomenon is caused by the peculiar shape of the clamshell bucket which is a circular part and can be turned as if circular arcs are traced. When the clamshell bucket turns relative to the ground, it bites into the soil like a circular arc so that the side surface of the clamshell bucket is brought into contact with or sticks to the soil along the circular arc which is generated by the tip end of the bucket. If the earth is clayey soil having fine granules, the sticky soil sticks to the outer periphery of the buckets, which prevents a gap, through which air enters, from being generated between the outer periphery of the buckets and the clayey soil so that the buckets become stuck to the clayey soil.

If the clamshell bucket becomes stuck to the clayey soil, it cannot be pulled upward, even if it is intended to be pulled up from the hole, so that a strong force is required to pull up the clamshell bucket. In such a state, the conventional deep excavator is likely to be damaged as it pulls out the clamshell bucket which is stuck to the clayey soil, or is likely to fall down. In such a case, the amount of soil which can be excavated by the bucket is reduced, thereby reducing the load applied to the clamshell bucket, which leads to ineffective working efficiency.

Accordingly, there has been proposed a construction machine to increase the capacity to pull up the weight and allowable load so as to cope with such a sticky phenomenon. However, if the excavator is designed to have such a large capacity, then such capacity is not needed in a normal excavating operation, and hence the machine is more complex and costly and yet such increased capacity is typically not frequently utilized.

In the conventional clamshell bucket having the aforementioned problems, it is often impossible to excavate the ground having sticky soil to form a deep hole. Accordingly, it is desired to develop a clamshell bucket capable of excavating such ground to form a deep hole without becoming stuck by the sticky soil.

In view of the aforementioned drawback of the conventional clamshell bucket arrangement, it is an object of the invention to provide a structure of a clamshell bucket and a hydraulic control circuit thereof capable of displacing the clamshell bucket relative to the hole in case of excavating clayey soil having high viscosity, thereby reducing the contact area between the clamshell bucket and the clayey soil and allowing air to enter into the contact surfaces therebetween so as to reduce the load applied to the clamshell bucket.

It is a first aspect of the invention to provide a structure of a clamshell bucket arrangement comprising a support shaft which is suspended substantially vertically, left and right buckets which are pivotally connected to both sides of a lower end of the support shaft, a pair of hydraulic cylinders which are interposed between the support shaft and the left and right buckets, wherein the left and right buckets are closed to hold soil when pistons of the hydraulic cylinders are extended and are opened to discharge the soil when the pistons of the hydraulic cylinders are contracted, and wherein the piston of one hydraulic cylinder has a stroke reserve so as to be further extendible so that the closed left and right buckets can be displaced to one side thereof relative to the vertical axes thereof.

It is a second aspect of the invention to provide a hydraulic control circuit of a structure of a clamshell bucket arrangement comprising a support shaft which is suspended substantially vertically, left and right buckets which are pivotally connected to both sides of the lower end of the support shaft, a pair of hydraulic cylinders which are interposed between the support shaft and the left and right buckets for opening and closing the left and right buckets when pistons of the hydraulic cylinders are contracted and extended, wherein the piston of one of the hydraulic cylinders has a stroke reserve so as to be further extendible in the longitudinal direction thereof even if the left and right buckets are closed, wherein the left and right buckets are closed to hold soil when the hydraulic cylinders are extended and are opened to discharge the soil when the pistons of the hydraulic cylinders are contracted, and wherein the hydraulic control circuit is characterized in that pressure chambers of the hydraulic cylinders are commonly connected to an oil supply passage through oil supply paths while discharge chambers of the hydraulic cylinders are commonly connected to an oil return passage through oil return paths, and a directional control valve is associated with the oil supply path of one hydraulic cylinder for disconnecting this hydraulic cylinder from the oil supply passage when hydraulic pressure of the oil in the oil passage is increased.

According to the present invention, the buckets are pivotally connected to both sides of the lower end of the support shaft and the hydraulic cylinders are interposed between the support shaft and each of the buckets at the back thereof. With the arrangement of this invention, it is possible to hold the soil by closing the buckets and to transfer the held soil to another place such as the bed of a truck, etc.

The hydraulic cylinders employed by the invention have different amounts of extension, namely, the amounts of extension of their pistons which are pulled out from them (hereinafter referred to as stroke length), and their stroke lengths are set in a manner such that when both pistons of the hydraulic cylinders are contracted at their maximum, both buckets are fully opened. Accordingly, when pistons of the hydraulic cylinders are extended so as to close both buckets, the piston of one cylinder is extended the maximum, but the piston of the other cylinder can be extended further (hereinafter called the piston of the cylinder having a stroke reserve). The stroke reserve corresponds to the difference of the stroke lengths of both pistons of the hydraulic cylinders, described hereinafter. As a result, when the buckets are stuck to the sticky soil such as clayey soil, the other piston is slightly extended relative to its cylinder while the one piston is contracted so that the pair of buckets can be sidewardly turned in one direction while the teeth of the buckets mesh one another to maintain the buckets closed. Consequently, both buckets are displaced from their central axes while they are kept closed so that the center of the hole and the center of the buckets are not aligned with each other, thereby reducing the areas of the buckets which contact the soil sticking to the buckets (hereinafter called the contact area of the buckets).

At this state, if the clamshell bucket is pulled up, air enters the gap defined between the buckets and the soil so as to easily pull the buckets apart from the soil. Further, since the contact area of the buckets is reduced, it is possible to reduce the force to pull the buckets from the hole compared with the case where the entire surfaces of the buckets are stuck by the soil. When the buckets are pulled out from the hole, both buckets can be freely turned due to their weight so that the oil under pressure can freely flow between both hydraulic cylinders. As a result, the central axes of the buckets can be realigned with their vertical lines.

DETAILED DESCRIPTION

Figure 1:
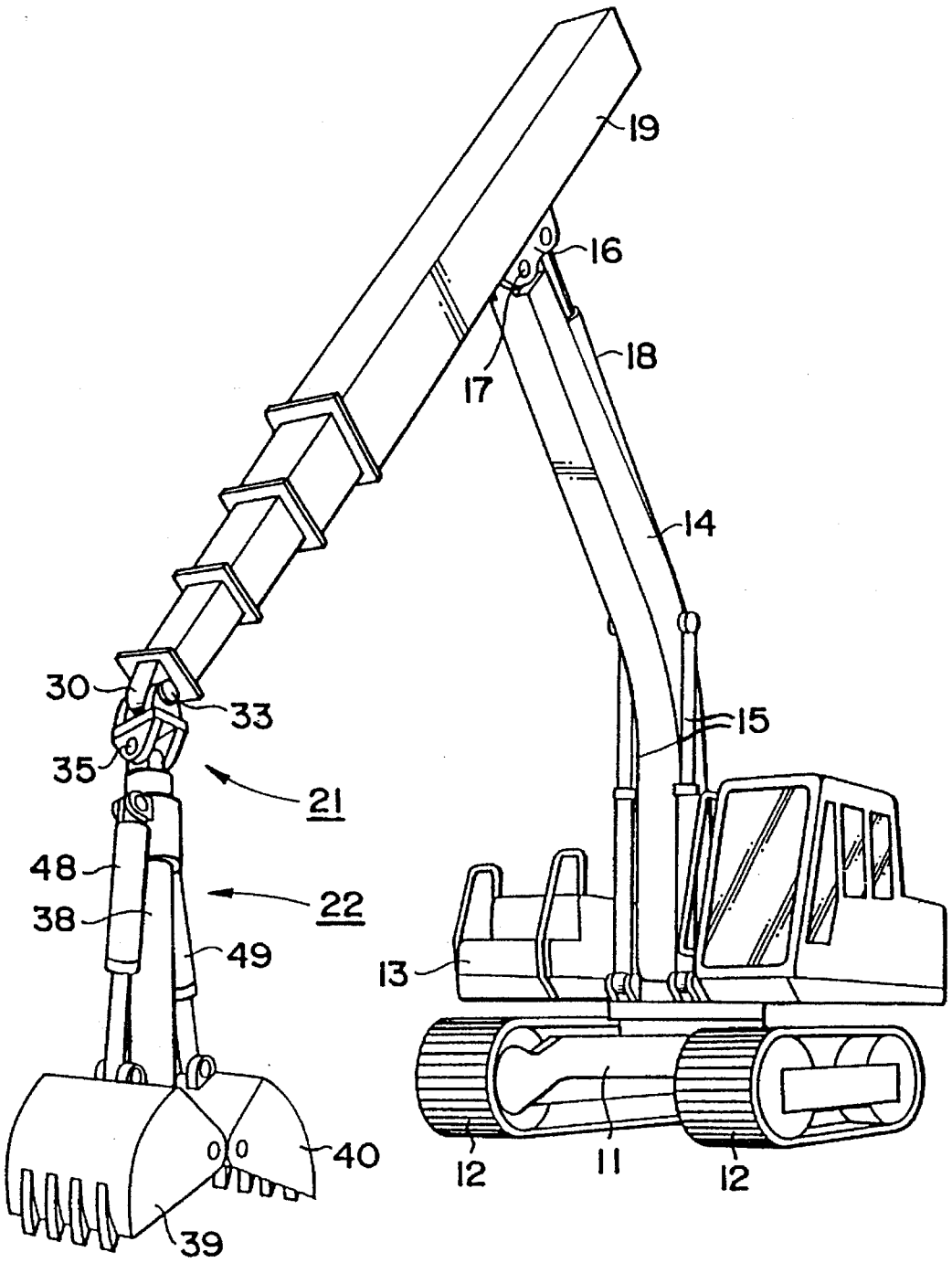
FIG. 1 is a perspective view showing the state where a clamshell bucket arrangement is suspended from a deep excavator according to a preferred embodiment of the invention.

A first aspect of the invention will be described hereinafter with reference to a deep excavator comprising a boom which is pivotally supported on a movable chassis, a stretchable arm assembly which is mounted on the boom and is stretchable in the longitudinal direction and comprises a plurality of telescopically assembled arms, and a clamshell bucket arrangement which is attached to a top arm of the stretchable arm assembly for excavating and holding earth and sand (i.e. soil). The deep excavator of this embodiment can excavate the earth to form a deep vertical hole.

Crawlers 12 are provided at both sides of a chassis 11 which is freely movable, i.e. right and left, forward and rearward by these crawlers 12. A turntable 13 on which an engine, an operator's room, etc. are mounted is disposed over the upper surface of the chassis 11 so as to be capable of turning 360° horizontally. A substantially L-shaped boom 14 is pivotally mounted on an upper front surface of the turntable 13 so as to be swingable vertically. A hydraulic cylinder 15 is interposed between the center of the boom 14 and the front surface of the turntable 13 for vertically turning the boom 14 relative to the turntable 13 at some angles.

A swing body 16 is pivotally coupled to the tip end of the boom 14 by pins 17 and another hydraulic cylinder 18 for adjusting the angular interval between the boom 14 and a boom body 19 is interposed between the center of the rear surface of the boom 14 and the swing body 16. The boom body 19 is fixedly mounted on the upper surface of the swing body 16. A stretchable arm assembly 20 comprising a plurality of telescopically movable arms (such as arms 20A, 20B, 20C) are inserted into the boom body 19. The stretchable arm assembly 20 can be extended and contracted in the longitudinal directions thereof by a hydraulic cylinder contained in the boom body 19. The boom body 19 can be vertically swingably moved by the hydraulic cylinder 18 together with the swing body 16.

A tongue-shaped flat plate-shaped coupling piece 30 is fixed to the tip end of the top arm 20C (tip end of the left side in FIG. 1) of the stretchable arm assembly 20 in the boom body 19. A universal-type joint 21 which is freely swingable is pivotally coupled to the coupling piece 30. A clamshell bucket arrangement 22 is pivotally coupled to and suspended from the lower end of the joint 21 by a pin 35 so as to be freely swingable. The clamshell bucket 22 is maintained to be always perpendicular to the earth along its axis due to its weight by way of the universal joint 21. A detailed arrangement of the joint 21 and clamshell bucket 22 will be described below.

Figure 2:
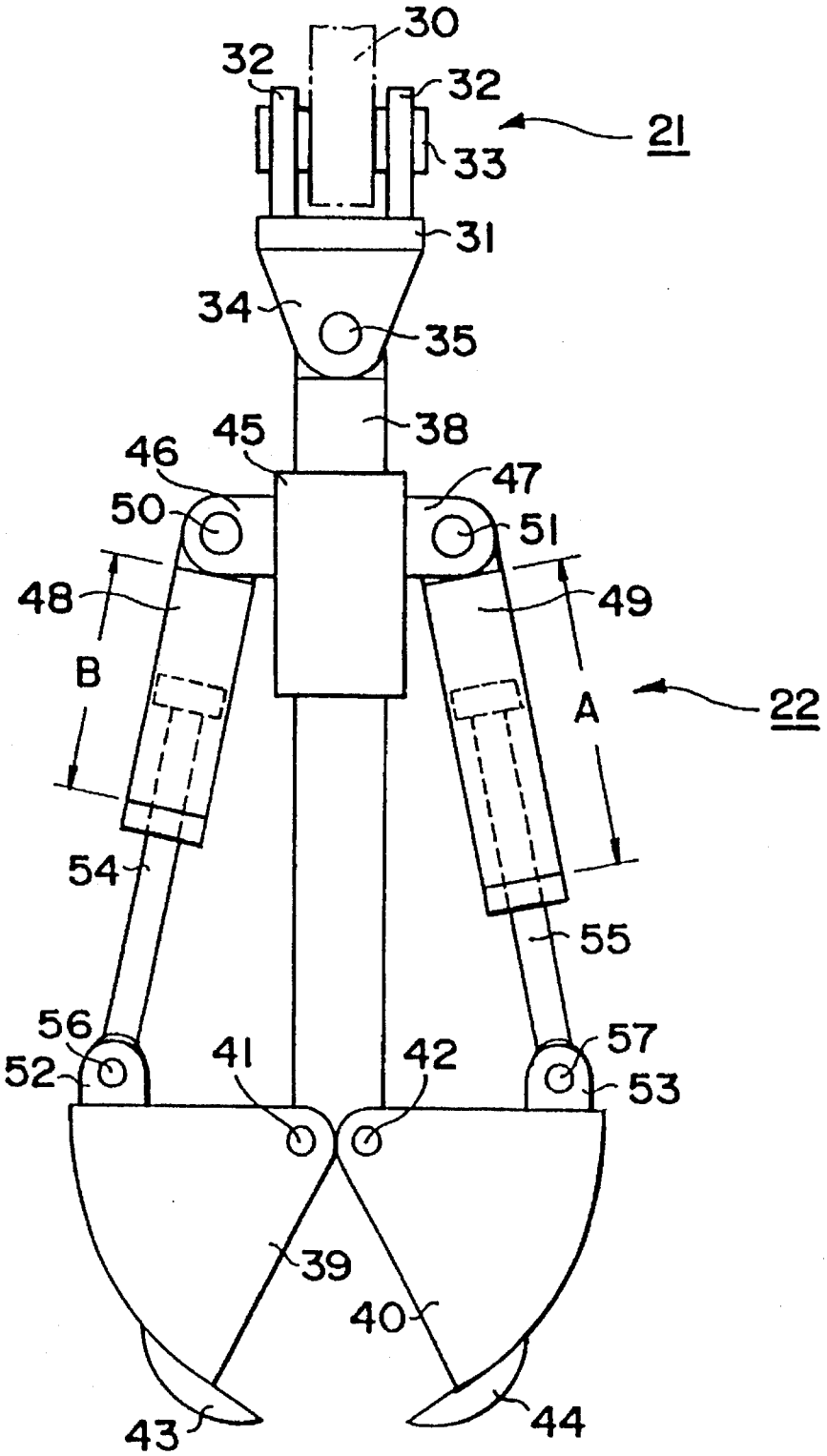
FIG. 2 is a side view of the clamshell bucket arrangement of FIG. 1.

FIG. 2 is a side view of the clamshell bucket 22 showing a detailed arrangement of the clamshell bucket 22.

The joint 21 can always suspend the clamshell bucket 22 vertically relative to the earth irrespective of the position of the boom body 19, namely the angular relation between the boom body 19 and the boom 14, and the bucket can be freely turned about the axes of the pins 33 and 35.

The joint 21 comprises a flat plate-shaped central member 31, and a pair of sidewardly spaced shaft supporters or plates 32 are fixed to the upper surface of the central member 31. The coupling piece 30 is inserted between the pair of shaft supporters 32. The coupling piece 30 and the shaft supporters 32 are coupled to each other by a pin 33 which penetrates the coupling piece 30 and shaft supporters 32. A pair of shaft supporters or plates 34 are fixed to the lower surface of the central member 31. An upper end of a support shaft 38, constituting the frame of the clamshell bucket 22, is inserted between the shaft supporters 34, and the shaft supporters 34 and the support shaft 38 are pivotally coupled to each other by a pin 35 which penetrates the shaft supporters 34 and support shaft 38 horizontally. The pin 35 is positioned with its axis perpendicular to the axis of pin 33 so that the axis of the shaft 38 can always be perpendicular to the earth, and hence the shaft 38 can always be suspended downward wherever the coupling piece 30 is positioned due to the free pivoting movement about the pins 33 and 35.

The shaft 38 can suspend the clamshell bucket 22 and has a rod shape having a slightly large diameter. A pair of buckets 39 and 40 are disposed at opposite sides, i.e. left and right sides of the lower end of the suspended shaft 38, so as to hold the soil. The lower end of the shaft 38 and the buckets 39 and 40 are pivotally coupled to one another by hinge pins 41 and 42 so that the buckets 39 and 40 can be respectively turned about the pins 41 and 42. The buckets 39 and 40 are partial circles in their cross sections and the pins 41 and 42 are positioned at the centers of the circular arcs which define the buckets 39 and 40. When the buckets 39 and 40 are turned about the pins 41 and 42, the traces of the outer peripheries of the buckets 39 and 40 are described as circles generated about the pins 41 and 42. Teeth 43 and 44 are fixed to the edge surfaces of the lower end openings of the buckets 39 and 40 which confront each other for biting into the soil.

A fixed sleevelike outer frame or collar 45 having a large diameter is fixed around the outer periphery of the support shaft 38 close to the upper end thereof (about one third from the upper end of the shaft 38), and cylinder receivers 46 and 47 each of which is paired are disposed symmetrically on opposite sides of shaft 38 and are fixed to the outer frame 45. A rear end of a hydraulic cylinder 48 is inserted between the pair of cylinder receivers 46, and the former and the latter are pivotally coupled to each other by a hinge pin 50. A rear end of a hydraulic cylinder 49 is inserted between the pair of cylinder receivers 47, and the former and the latter are pivotally coupled to each other by a hinge pin 51. A pair of rod receivers 52 are fixed to an upper edge central portion of the bucket 39, and a tip end of a piston rod 54, which is operable by the hydraulic cylinder 48, is inserted between the rod receivers 52 and is pivotally coupled thereto by a pin 56. Likewise, a pair of rod receivers 53 are fixed to an upper edge central portion of the bucket 40, and a tip end of a piston rod 55, which is operable by the hydraulic cylinder 49, is inserted between the rod receivers 53 and is pivotally coupled thereto by a pin 57. Such an arrangement of the clamshell bucket 22 is conventional and well known.

Figure 4:
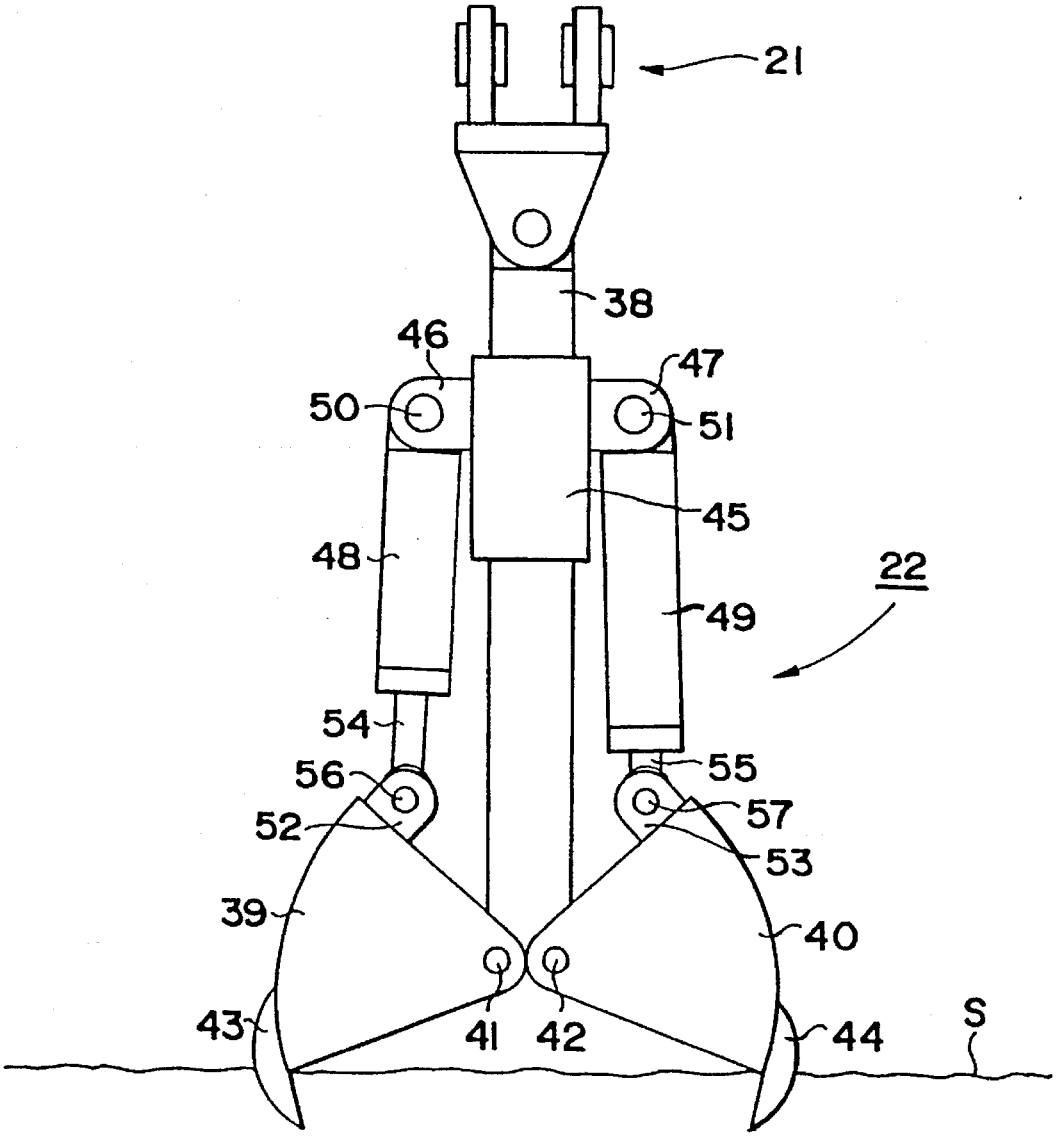
FIG. 4 is a side view showing the operation of the clamshell bucket arrangement wherein the buckets are fully opened to bite into soil.
Figure 5:
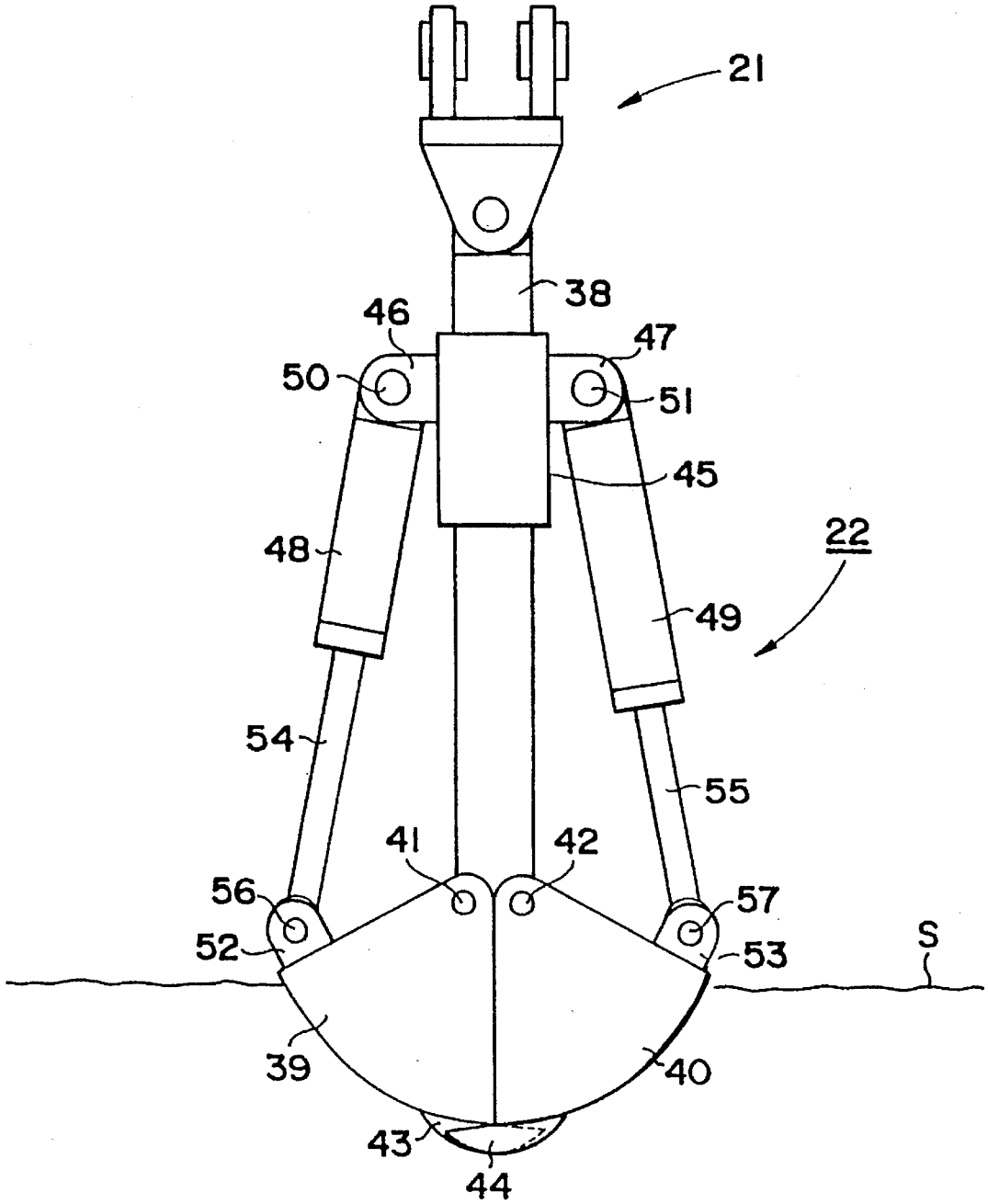
FIG. 5 is a side view showing the operation of the clamshell bucket arrangement wherein the buckets are closed to hold the soil therein.

However, the hydraulic cylinders 48 and 49 of the clamshell bucket 22 of the present invention have a feature which has not been in those provided on a conventional clamshell bucket. In this invention, the hydraulic cylinders 48 and 49 have different stroke lengths, that is, the stroke length of the piston of one cylinder is different from that of the other cylinder. As shown in FIG. 2, the stroke length A of the piston of the hydraulic cylinder 49 is set to be longer than the stroke length B of the piston of the hydraulic cylinder 48. At the state where the pistons of both hydraulic cylinders 48 and 49 are contracted at their maximum, both piston rods 54 and 55 are pulled into the hydraulic cylinders 48 and 49. In this state, the buckets 39 and 40 are fully opened about the pins 41 and 42 so that the buckets 39 and 40 are opened symmetrically about the support shaft 38 as shown in FIG. 4. From this state, when the hydraulic cylinders 48 and 49 are operated so that the piston rods 54 and 55 are respectively extended, namely they are pushed out from the housings of the hydraulic cylinders 48 and 49, this causes both piston rods to be extended through the same stroke and thereby closes the buckets 39 and 40 as shown in FIG. 5. At this state, the piston rod 54 of the hydraulic cylinder 48 is fully extended (i.e., is at its maximum stroke length), but the piston rod 55 of the hydraulic cylinder 49 is in an intermediate position and can be extended further. Such a stroke reserve is caused by the difference of the stroke lengths of the pistons of the hydraulic cylinders 48 and 49. That is, the difference between the stroke lengths A and B becomes the stroke reserve, namely, the length of play by which the piston of the hydraulic cylinder 49 can extend further.

Figure 3:
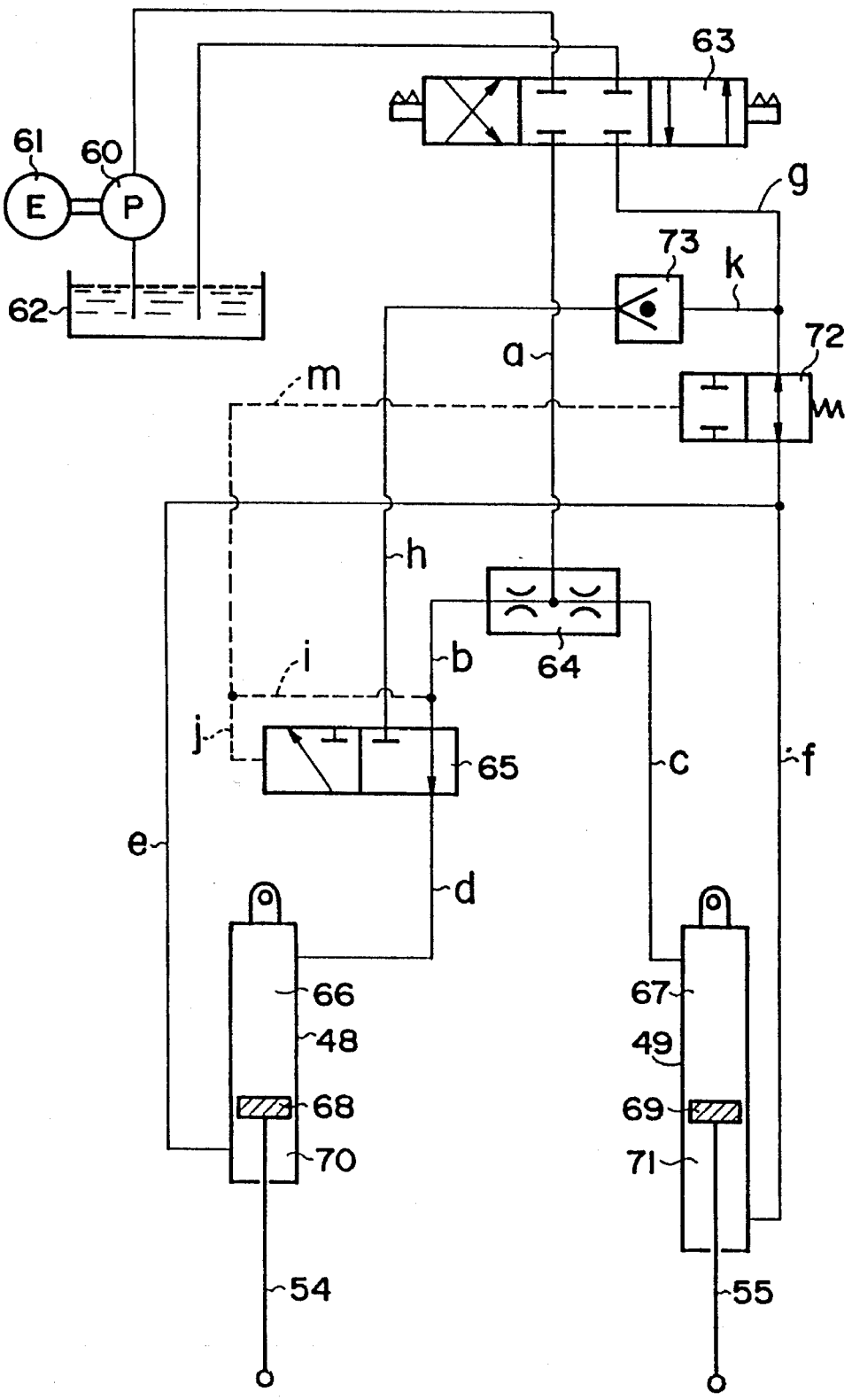
FIG. 3 is a view showing a hydraulic control circuit for driving the clamshell bucket arrangement of FIG. 1.

FIG. 3 is a hydraulic control circuit for operating the clamshell bucket 22 of the present invention.

A pressure oil pump 60 which is driven by an engine 61 accommodated in the chassis 11 communicates at its suction side with a pressure oil tank 62 which accommodates oil under pressure therein. A discharge side of the oil under pressure from the pump 60 is connected to a three-directional control valve 63 which can be switched to three positions. A discharge side of the directional control valve 63 is connected to the oil tank 62 so that oil is returned to the tank 62.

An oil passage a serving as an oil supply passage is connected to one end of the directional control valve 63 and the oil passage a is connected to a common end of a flow dividing valve 64 which can divide the flow of the oil under pressure into two directions. Oil passages b and c are connected to opposite ends of the flow dividing valve 64. The oil passage b is connected to one port, which is normally opened, of a directional control valve 65. An oil passage d is connected to the other port, which is normally opened, of the directional control valve 65 and also connected to a pressure chamber of the hydraulic cylinder 48. The directional control valve 65 can switch the communication of the oil passages b and d to the communication of oil passages d and h when the pressure in the oil passage b is increased. The oil passage h is connected to a port, which is normally closed, of the directional control valve 65. The oil passages b and d normally communicate with each other but their communication is interrupted and the oil passage d communicates with the oil passage h when the pressure in the oil passage b is increased.

A piston 69, which slides in the hydraulic cylinder 49 by oil under pressure, is airtightly accommodated in the hydraulic cylinder 49 and it is connected to a distal end of the piston rod 55. The inside of the hydraulic cylinder 49 is separated into a pressure chamber 67 and a return chamber 71 by the piston 69. Likewise, a piston 68, which slides in the hydraulic cylinder 48 by oil under pressure, is airtightly accommodated in the hydraulic cylinder 48 and it is connected to a distal end of the piston rod 54. The inside of the hydraulic cylinder 48 is separated into a pressure chamber 66 and a return chamber 70 by the piston 68.

An oil passage f is connected to the return chamber 71 of the hydraulic cylinder 49 and also connected to one port, which is normally opened, of a directional control valve 72. An oil passage g as a return oil passage is connected to the other port, which is normally opened, of the directional control valve 72. A distal end of the oil passage g is connected to the solenoid control valve 63. The solenoid control valve 63 is normally opened but it can close its flow passages when the pressure is applied to its operation end.

An oil passage e is connected to the return chamber 70 of the hydraulic cylinders 48 and it merges with the oil passage f and the merged oil passage is connected to one port, which is normally opened, of the directional control valve 72.

An oil passage i is branched from the oil passage b for controlling the hydraulic pressure and it communicates with an oil passage j which is connected to an operation end of the directional control valve 65. Both the oil passages i and j merge with an oil passage m and a distal end of the oil passage m is connected to an operation end of the directional control valve 72. An oil passage k is branched from the oil passage g and it is connected to a one-way check valve 73 for permitting the oil under pressure to flow in one direction. The check valve 73 is connected to the oil passage h, a distal end of which is connected to the port, which is normally closed, of the directional control valve 65. The check valve 73 permits the oil under pressure to flow from the direction of the oil passage h to the oil passage k but it prevents the oil under pressure from flowing from the direction of the oil passage k to the oil passage h.

The operation of the present invention will be described with reference to FIGS. 4 to 8. Described firstly is a case of excavating sticky soil by the clamshell bucket 22 and secondly is a case where the clamshell bucket 22 is difficult to pull up when the buckets 39 and 40 are stuck to the sticky soil. Thereafter, there are described sequential operations of the clamshell bucket 22 in the order of FIGS. 4, 5, 6, 7 and 8 and the procedure from the state where the buckets 39 and 40 are fully opened in FIG. 4 to the state where the clamshell bucket 22 is pulled up from the hole in FIG. 8.

When excavating the earth to form a deep hole, the hydraulic cylinders 15 and 18 are first operated, thereby vertically swinging the boom 14 and the boom body 19 so that the clamshell bucket 22 can be moved immediately over the hole to be formed. Then, the hydraulic cylinders 15 and 18 are adjusted so as to extend and contract the pistons thereof so that the boom body 19 is raised to become perpendicular relative to the axis of the hole. Thereafter, a hydraulic cylinder, not shown, incorporated in the boom body 19 is operated to extend the boom body 19 so that the joint 21 suspended from the top arm of the boom body 19 and the clamshell bucket 22 pivotally coupled to the joint 21 are respectively inserted into the hole. When the buckets 39 and 40 of the clamshell bucket 22 contact the bottom of the hole, the hydraulic cylinders 48 and 49 are operated to close the buckets 39 and 40 so as to hold the soil. When the soil is held by the buckets 39 and 40, the hydraulic cylinder incorporated in the boom body 19 is operated so as to contract the entire length of the stretchable arm assembly, thereby pulling the clamshell bucket 22 out from the hole. Successively, the hydraulic cylinders 15 and 18 are operated so as to vertically swing the boom 14 and the boom body 19 and lift the clamshell bucket 22 to an intended height so that the clamshell bucket 22 is moved to a position adjacent the ground or the bed of the truck. Finally, the hydraulic cylinders 48 and 49 are operated to open the buckets 39 and 40 so that the held soil is dropped on the ground or on the bed of the truck.

When the soil is excavated by the clamshell bucket 22, the pistons 68 and 69 of the hydraulic cylinders 48 and 49 are contracted as shown in FIG. 4 so as to pull the piston rods 54 and 55 into the hydraulic cylinders 48 and 49 so as to turn the buckets 39 and 40 about the pins 41 and 42 so that the buckets 39 and 40 are fully opened. At this state, the openings of the buckets 39 and 40 are directed downward and the teeth 43 and 44 are also directed downward. In such a posture, when the clamshell bucket 22 is forced to drop to the ground or soil S, the teeth 43 and 44 bite into the soil S from the surface thereof (refer to FIG. 4).

In such a state, the directional control valve 63 is switched to a normal position so that the oil under pressure generated in the pressure oil pump 60 is supplied to the oil passage a. The oil under pressure entering the flow dividing valve 64 from the oil passage a is divided to the left and right by the flow dividing valve 64 by the same amount and the divided oil under pressure flows into the oil passages b and c. The oil under pressure which flows into the passage b passes through the directional control valve 65 and the oil passage d, and then enters the pressure chamber 66 of the hydraulic cylinder 48. The oil under pressure is expanded in the pressure chamber 66, the piston 68 is pushed downward in the hydraulic cylinder 48 and the piston rod 54 is pushed out from the hydraulic cylinder 48. The oil under pressure which flows into the oil passage c enters the pressure chamber 67 of the hydraulic cylinder 49 and it is expanded in the pressure chamber 67 so that the piston 69 is pushed downward in the hydraulic cylinder 49 and the piston rod 55 is pushed out from the hydraulic cylinder 49. The oil under pressure which remains in the return chamber 70 of the hydraulic cylinder 48 is pushed toward the oil passage e by the movement of the piston 68 while the oil under pressure which remains in the return chamber 71 of the hydraulic cylinder 49 is pushed toward the oil passage f by the movement of the piston 69. The oil under pressure from the oil passage e and that from the oil passage f merge with each other. The merged oil under pressure passes through the directional control valve 72 and flows into the oil passage g, then passes through the directional control valve 63, and finally it is returned to the tank 62 where it is collected. With such a flow of the oil under pressure, the hydraulic cylinders 48 and 49 perform the operation to push the pistons 68 and 69.

In such a manner, namely, when the piston rods 54 and 55 are extended by the operation of hydraulic cylinders 48 and 49, the intervals or distances between the pins 50 and 56 and between the pins 51 and 57 are respectively increased so that the piston rod receivers 52 and 53 are pushed, whereby the bucket 39 is turned counterclockwise about the pin 41 while the bucket 40 is turned clockwise about the pin 42. As a result, the buckets 39 and 40 are closed while the teeth 43 and 44 thereof mesh with one another so that the buckets 39 and 40 hold the soil at the inside thereof and they bit into the ground S at the peripheries thereof (refer to FIG. 5).

When the teeth 43 and 44 of both buckets 39 and 40 mesh with one another, the piston rod 54 of the hydraulic cylinder 48 is extended its maximum, but the piston 69 of the hydraulic cylinder 49 still has a stroke reserve, namely it can be extended further. That is, since the piston 69 in the hydraulic cylinder 49 does not reach the lower end of the hydraulic cylinder 49 if the oil under pressure is continuously supplied to the pressure chamber 67, there remains additional stroke length for pushing the piston rod 55 downward.

At the state as shown in FIG. 5, if the buckets 39 and 40 bite into the ground S of sticky soil having high viscosity, a large load is applied to the buckets 39 and 40 when the clamshell bucket 22 is pulled out from the hole since the partial circular lower surfaces of the buckets 39 and 40 become stuck to the clayey soil. Under such circumstances, the directional control valve 63 is switched or returned to the normal position so as to continuously supply additional oil under pressure toward the oil passage a so that the buckets 39 and 40 are turned while they are displaced about the axes thereof.

That is, the additional oil under pressure which passes through the oil passage a and flow dividing valve 64 is supplied to the oil passage o and thence into the pressure chamber 67. Since the piston 69 in the hydraulic cylinder 49 can be extended further, the piston 69 is thus capable of being moved further downward. However, the piston 68 in the hydraulic cylinder 48 is already positioned at the lowest position of the hydraulic cylinder 48, so that the piston 68 and piston rod 54 cannot be extended downward. Further, since both the buckets 39 and 40 contact the soil, they cannot be further turned toward one another, and hence the piston 69 of the hydraulic cylinder 49 cannot be extended further, even if it is intended to be extended based on the stroke reserve of piston 69 of the hydraulic cylinder 49. Accordingly, hydraulic pressure of the oil under pressure in the oil passages b and c is increased because of additional oil under pressure which is supplied from the flow dividing valve 64. A part of the oil under pressure is applied to the operation end of the directional control valve 65 through the oil passages i and j so as to increase hydraulic pressure of the oil under pressure at the operation end of the directional control valve 65, and hence the directional control valve 65 is switched by the increased hydraulic pressure. As a result, the communication between the oil passages b and d is interrupted but the oil passages d and h now communicate with each other. The pressure chamber 66 now communicates with the oil passage g as the oil return passage through the oil passage d, directional control valve 65, oil passage h, check valve 73 and oil passage k. The oil under pressure from the oil passage i is transmitted at the same time to the operation end of the directional control valve 72 through the oil passage m so that the directional control valve 72 is switched to interrupt the communication between the oil passages f and g.

As mentioned above, when the flow of the oil under pressure is switched by the directional control valves, the oil under pressure which flows into the oil passage c enters the pressure chamber 67 so as to push the piston 69 downward so that the cylinder rod 55 is extended from the hydraulic cylinder 49. When the piston 69 slides downward in the hydraulic cylinder 49, the oil under pressure remaining in the discharge chamber 71 of the hydraulic cylinder 49 is discharged. The discharged oil under pressure flows into the oil passage f and enters the discharge chamber 70 of the hydraulic cylinder 48 through the oil passage e. Accordingly, the oil under pressure is expanded in the discharge chamber 70 so that the piston 68 is pushed upward so as to pull the cylinder rod 54 into the hydraulic cylinder 48. At the same time, since the piston 68 slides inside the hydraulic cylinder 48, the oil under pressure remaining inside the pressure chambers 66 flows into the oil passage d and then flows through the directional control valve 65, oil passage h, check valve 73, oil passage k, oil passage g and directional control valve 63 into tank 62.

Thus, when the pressure of the oil under pressure in the oil passage b is low, the oil under pressure is supplied from the oil passage a to the hydraulic cylinders 48 and 49 through the flow dividing valve 64 so that both hydraulic cylinders 48 and 49 are connected in parallel to each other by way of the flow dividing valve 64. On the other hand, when the pressure of the oil under pressure in the oil passage b is high, both hydraulic cylinders 48 and 49 are connected to each other in series so that the pistons 68 and 69 of both hydraulic cylinders 48 and 49 respectively perform contraction and extension operations in synchronization with one another. As a result, in this latter condition, the direction of the operations of piston rods 54 and 55 are opposite.

Figure 6:
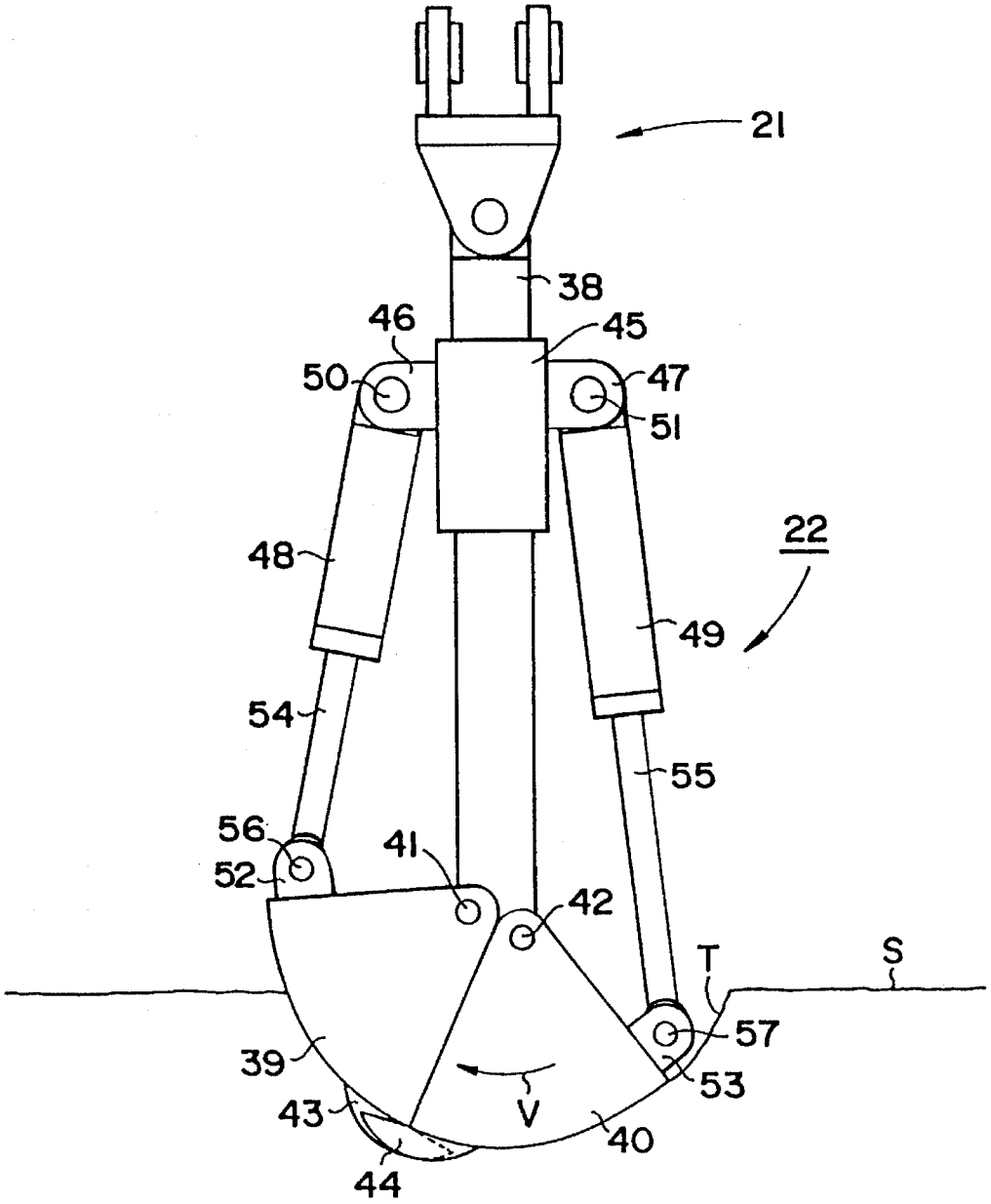
FIG. 6 is a side view showing the operation of the clamshell bucket arrangement wherein the buckets are sidewardly displaced from the axes thereof.

As mentioned above, when the pressure of the oil under pressure is increased in the oil passage b, the piston rods 54 and 55 operate in opposite directions in that the piston rod 55 is pushed out from the hydraulic cylinder 49 and the piston rod 54 is pulled into the hydraulic cylinder 48. Accordingly, the pin 57 and rod receiver 53 which are coupled to the piston rod 55 are lowered so as to turn the bucket 40 clockwise about the pin 42, and at the same time the pin 56 and rod receiver 52 coupled to the piston rod 54 are raised so as to turn the bucket 39 clockwise about the pin 41. In such a manner, the buckets 39 and 40 which are pivotally coupled to the lower end of the suspended shaft 38 are both turned in the direction of arrow V in FIG. 6 about the pins 41 and 42 and are thus displaced leftward relative to the center vertical axis of the shaft 38, and the buckets are stopped when they are positioned at the position where the back edge of the bucket 39 is substantially parallel with the ground S as shown in FIG. 6. At this time, the buckets 39 and 40 bite into the ground S so as to form a circular arc hole T in the direction from the surface to the lower side of the ground S and the buckets 39 and 40 stick to the surface of the hole T.

The buckets 39 and 40 which bite into the surface of the ground S are sidewardly displaced while they hold the soil inside them in the hole T so that the contact area between the outer surfaces of the buckets 39 and 40 and the surface of the hole T is reduced. Furthermore, when the buckets 39 and 40 are turned, air enters the contact area so that the buckets 39 and 40 can be easily pulled apart from the hole T.

Figure 7:
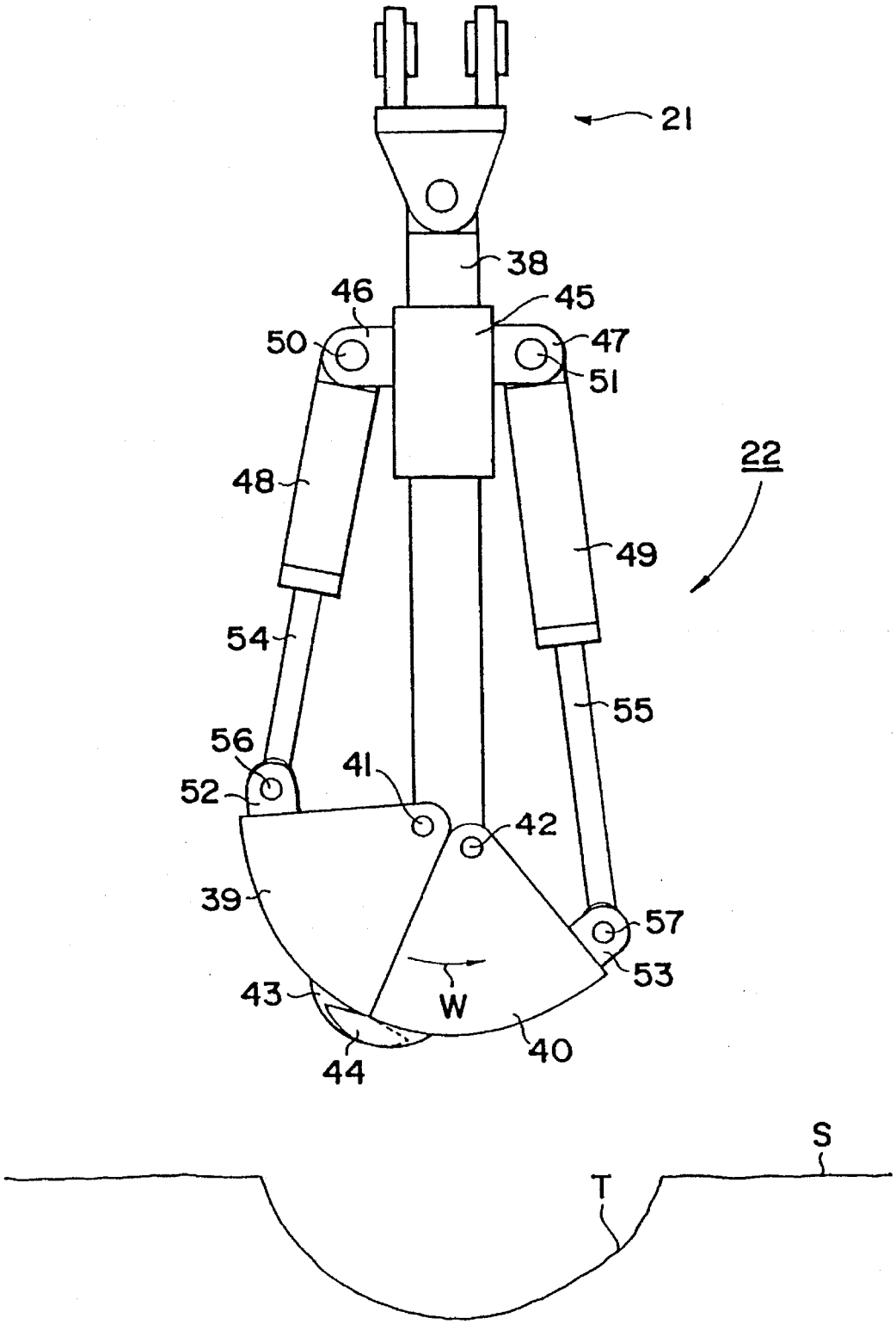
FIG. 7 is a side view showing the operation of the clamshell bucket arrangement wherein the buckets are pulled up while they are displaced from the axes thereof.

As shown in FIG. 6, when the centers of the buckets 39 and 40 are displaced from the center of the hole T so as to reduce the contact area of the buckets 39 and 40, thereby reducing the sticking force with the soil, the clamshell bucket 22 can be easily pulled up from the hole T. That is, the hydraulic cylinder incorporated in the boom body 19 is operated, thereby reducing the entire length of the stretchable arm assembly of the boom body 19, then the clamshell bucket 22 is pulled up by the joint 21 pivotally coupled to the top arm of the stretchable arm assembly so that the buckets 39 and 40 can be pulled upwardly from the hole T. The force to pull the buckets 39 and 40 apart from the hole T according to the present invention is far less than that in the prior art where the outer peripheral surfaces of the buckets 39 and 40 are stuck by the inner surface of the hole T, whereby the buckets 39 and 40 of this invention can be easily pulled apart from the hole T. FIG. 7 shows the state where the buckets 39 and 40 are raised above the hole while holding the soil inside.

When the buckets 39 and 40 are pulled apart from the hole T and suspended in midair, as shown in FIG. 7, the directional control valve 63 is returned to a neutral position as shown in FIG. 3, thereby stopping the supply of the oil under pressure to the oil passage a. As a result, hydraulic pressure applied to the operation end of the directional control valve 65 through the oil passage a, flow dividing valve 64, and oil passages b, i and j is reduced so that the directional control valve 65 is returned to the normal state, whereby the directional control valve 65 permits the oil passage b to communicate with the oil passage d and also interrupts the communication between the oil passages d and h. Accordingly, the pressure chambers 66 and 67 communicate with each other through the oil passage c, flow dividing valve 64, and oil passages b and d. Since the discharge chambers 70 and 71 also communicate with each other through the oil passages e and f, the pressure chambers 66 and 67 and the discharge chambers 70 and 71 are connected in parallel with one another so that the oil under pressure flows freely between the hydraulic cylinders 48 and 49. Further, when the buckets are suspended but displaced from the central axes thereof, a returning force is applied to the buckets which tends to turn the buckets 39 and 40 in the direction of arrow W in FIG. 7, which returning force is due to the weight of the buckets and of the soil therein.

This returning force operates to pull the piston rod 55 into the hydraulic cylinder 49 so that the oil under pressure in the pressure chamber 67 is pushed toward the oil passage c. Accordingly, the oil under pressure enters the pressure chamber 66 through the oil passage c, flow dividing valve 64, oil passage b, directional control valve 65 and oil passage d so that the piston 68 is pushed downward inside the hydraulic cylinder 48 and the cylinder rod 54 is extended from the hydraulic cylinder 48. As a result, the piston rod 55 is contracted into the hydraulic cylinder 49 and at the same time the piston rod 54 is extended from the hydraulic cylinder 48 so that the bucket 40 is turned counterclockwise about the pin 42 while the bucket 39 is turned counterclockwise about the pin 41, which enables the buckets 39 and 40 to automatically return to the original position wherein the contact surfaces of both buckets 39 and 40 are substantially perpendicular to the ground. At this time, when the piston 68 lowers inside the hydraulic cylinder 48, the oil under pressure in the discharge chamber 70 of the hydraulic cylinder 48 enters the discharge chamber 71 of the hydraulic cylinder 49 through the oil passages e and f. Accordingly, the oil under pressure is expanded in the discharge chamber 71 so that the piston 69 is pushed upward while the piston rod 55 is contracted in the hydraulic cylinder 49, whereby the amount of extension and contraction of both piston rods 54 and 55 are synchronized with each other.

Figure 8:
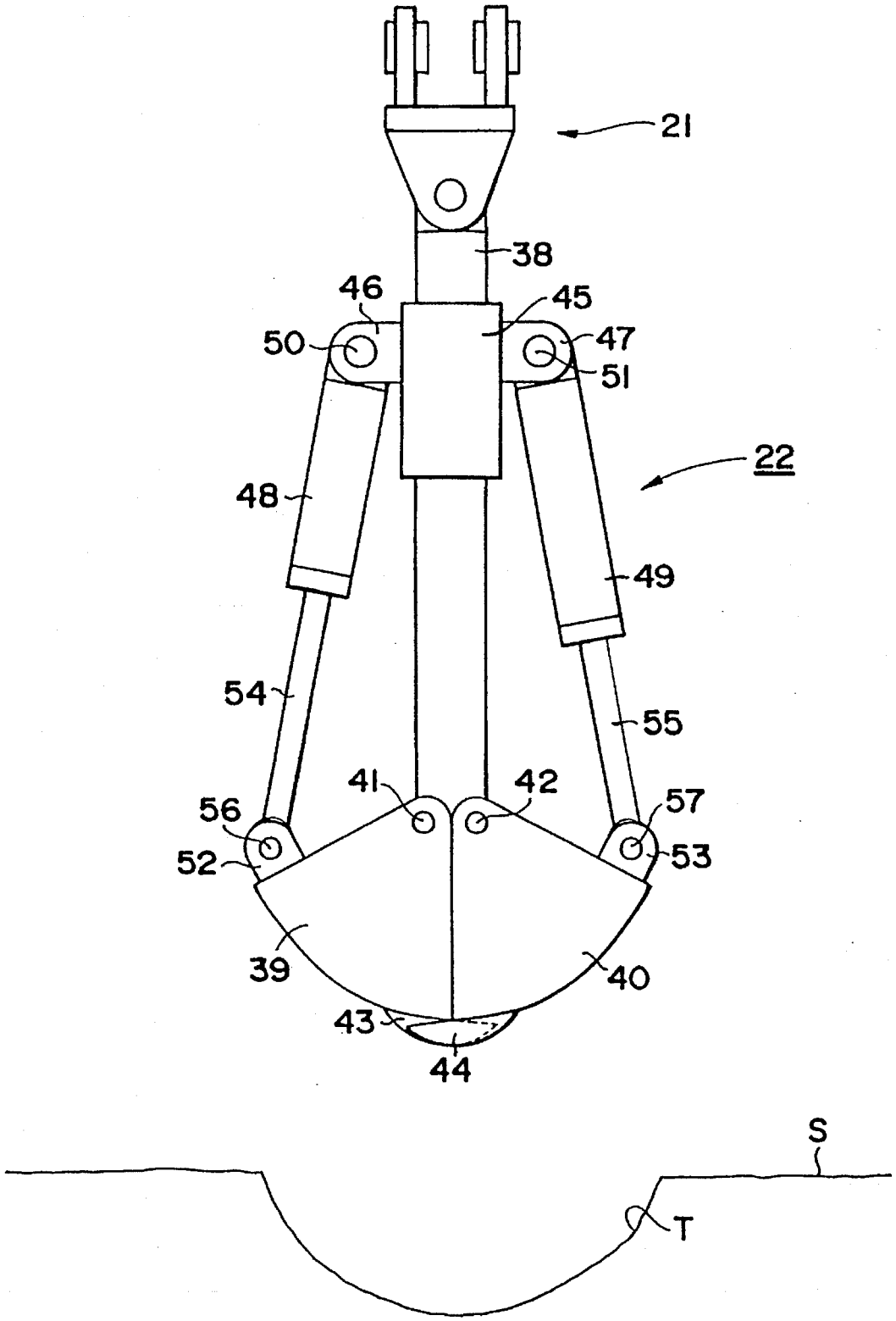
FIG. 8 is a side view showing the operation of the clamshell bucket arrangement wherein the buckets are returned to their original state due to their weight after they are pulled up as shown in FIG. 7.

In such a manner, the buckets 39 and 40 are turned in the direction of the arrow W while they are closed as shown in FIG. 7 so that the buckets 39 and 40 are returned to their original positions without dropping the held soil. In the series of the operations as mentioned above, the buckets are swung back so that the contact surfaces thereof are positioned perpendicular to the earth from the state where they are displaced from their axes and they are balanced with each other in their weights as shown in FIG. 8. If the entire length of the stretchable arm assembly is contracted in such a balanced state, the clamshell bucket 22 can be raised from the bottom of the hole to the surface of the ground, so that the soil held by the buckets 39 and 40 can be raised from the hole.

Thereafter, when the soil excavated by the buckets 39 and 40 is transferred to and dropped to the ground or the bed of a truck, the directional control valve 63 is changed from the neutral position to the reverse position. By this change, the oil under pressure from the pressure oil pump 60 enters the oil passage g and passes through the directional control valve 72 and is divided into two oil passages e and f (since the check valve 73 is disposed in the direction opposite to the flow of the oil under pressure, the oil under pressure does not flow from the oil passage k to the oil passage h), and then it enters the discharge chambers 70 and 71. The oil under pressure which is expanded in the discharge chamber 70 pushes the piston 68 upward in the hydraulic cylinder 48 and contracts the piston rod 54 in the hydraulic cylinder 48 while oil under pressure which is expanded in the discharge chamber 71 pushes the piston 69 upward in the hydraulic cylinder 49 and contracts the piston rod 55 in the hydraulic cylinder 49. Accordingly, the bucket 39 is turned clockwise about the pin 41 and at the same time the bucket 40 is turned counterclockwise about the pin 42 so that the contact surfaces of the buckets 39 and 40 are moved away from each other and they are opened in the downward direction. In such a manner, the soil held by the buckets 39 and 40 are transferred to the ground or the bed of the truck.

With the repetitions of these operations, the soil can be excavated by the clamshell bucket 22 and it is raised by the buckets 39 and 40, whereby the hole can be deepened successively.

With the aforementioned arrangement of the present invention, it is possible to displace the two buckets which are pivotally coupled to both sides of the lower end of the clamshell bucket arrangement without significantly changing the basic structure of the conventional clamshell bucket. The displacing operation of the buckets can be performed by adjusting the extension amount of the pistons of the hydraulic cylinders and controlling the supply of the oil under pressure, thereby simplifying the function of the clamshell bucket. Even if the teeth of the buckets bite into the sticky soil having high viscosity and the buckets are stuck by the sticky soil, the axes of the buckets can be displaced relative to the axis of the hole formed by the buckets so that the contact area between the buckets and the sticky soil is reduced and at the same time air enters between the contact surfaces, whereby the force to pull out the buckets can be reduced.

As mentioned above, since the hydraulic control circuit is very simple, the hydraulic control circuit of the invention can operate by improving a part of the conventional hydraulic circuit and it can be manufactured with low cost. When the buckets are pulled out from the sticky soil having high viscosity, the force for pulling out the buckets is not necessary to be increased, so that the load applied to the chassis, boom and stretchable arm assembly is reduced. As a result, it is not necessary to design the structure so as to permit the maximum load to be applied to the buckets to be large, thereby reducing the capacity of the excavator as a whole.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a structure of a clamshell bucket comprising a support shaft suspended substantially vertically, left and right buckets pivotally connected to both sides of a lower end of the support shaft, a pair of hydraulic cylinders interposed between the support shaft and the left and right buckets, wherein the left and right buckets are closed to hold soil therein when pistons of the hydraulic cylinders are extended while the buckets are opened to discharge the soil when the pistons of the hydraulic cylinders are contracted, the improvement wherein the piston of one of the pair of hydraulic cylinders has a stroke reserve so as to be further extendible even if the piston of the other of the pair of hydraulic cylinders is fully extended so that the closed left and right buckets can be movably sidewardly displaced relative to the vertical.

2. A structure according to claim 1, wherein the piston of the other hydraulic cylinder is extended to its maximum length when the left and right buckets are closed and the piston of the one hydraulic cylinder has a stroke reserve so as to be further extendible when the left and right buckets are closed, and wherein the piston of the one hydraulic cylinder is further extended after the left and right buckets are closed by extending the piston of the one hydraulic cylinder so that the left and right buckets are displaced sidewardly and the piston of the other hydraulic cylinder is contracted by the extension force of the piston of the one hydraulic cylinder.

3. In a structure of a clamshell bucket comprising a long support shaft suspended substantially vertically from a tip end of a top arm, left and right buckets pivotally connected to both sides of a lower end of the support shaft and being of substantially partial-circular shape in cross section, a plurality of teeth fixed to each of the left and right buckets at the portion where they contact each other, one hydraulic cylinder interposed between an upper end of the support shaft and a back surface of the left bucket and having a piston which can be contracted and extended, another hydraulic cylinder interposed between an upper end of the support shaft and a back surface of the right bucket and having a piston which can be contracted and extended, wherein the pistons of the hydraulic cylinders are contracted a maximum so as to fully open the left and right buckets and are extended so as to close the left and right buckets, and wherein the piston of at least one of the hydraulic cylinders has a stroke reserve so as to be further extendible even when the left and right buckets are closed.

4. In a hydraulic control circuit of a structure of a clamshell bucket comprising a support shaft suspended substantially vertically, left and right buckets pivotally connected to both sides of a lower end of the support shaft, a pair of hydraulic cylinders interposed between the support shaft and the left and right buckets for opening and closing the left and right buckets when pistons of the hydraulic cylinders are contracted and extended, wherein the piston of one said hydraulic cylinder has a stroke reserve so as to be further extendible in the longitudinal direction thereof even if the left and right buckets are closed, and wherein the left and right buckets are closed to hold soil when the hydraulic cylinders are extended and are opened to discharge the soil when the pistons of the hydraulic cylinders are contracted, the hydraulic control circuit is characterized in that pressure chambers of the hydraulic cylinders are commonly connected to an oil supply passage through oil supply passes while discharge chambers of the hydraulic cylinders are commonly connected to an oil return passage through oil return passes, and a directional control valve is associated with the oil supply passes between the oil supply passage and the hydraulic cylinder for disconnecting the hydraulic cylinder from the oil supply passage when hydraulic pressure of oil in the oil supply pass is increased.

5. In a hydraulic control circuit according to claim 4, wherein the directional control valve is switched when hydraulic pressure of the oil in the oil supply pass is increased to disconnect the hydraulic cylinder from the oil supply pass and to connect the hydraulic cylinder to an oil return pass.

6. A hydraulic control circuit according to claim 5, further including a directional control valve which is disposed between the hydraulic cylinders and the oil return passage and is switched to disconnect hydraulic cylinders from the return oil passage when hydraulic pressure of the oil under pressure in the oil supply pass is increased.

7. A hydraulic control circuit according to claim 4, further including a directional control valve which is disposed between the hydraulic cylinders and the oil return passage and is switched to disconnect hydraulic cylinders from the return oil passage when hydraulic pressure of the oil in the oil supply pass is increased.

* * * * *